US011859270B2

(12) United States Patent
Sivaraman et al.

(10) Patent No.: US 11,859,270 B2
(45) Date of Patent: Jan. 2, 2024

(54) NON-MAGNESIUM PROCESS TO PRODUCE COMPACTED GRAPHITE IRON (CGI)

(71) Applicant: SNAM ALLOYS PVT LTD, Hosur (IN)

(72) Inventors: Srikanth Sivaraman, Hosur (IN); Gowri Subhramanyam, Hosur (IN); Nadimuthu Srinivasan, Hosur (IN); Harisankar Radhakrishnan, Hosur (IN)

(73) Assignee: SNAM ALLOYS PVT LTD, Hosur (IN)

( * ) Notice: Subject to any disclaimer, the term of this patent is extended or adjusted under 35 U.S.C. 154(b) by 748 days.

(21) Appl. No.: 16/332,409

(22) PCT Filed: Sep. 12, 2017

(86) PCT No.: PCT/IB2017/055473
§ 371 (c)(1),
(2) Date: Mar. 12, 2019

(87) PCT Pub. No.: WO2018/047134
PCT Pub. Date: Mar. 15, 2018

(65) Prior Publication Data

US 2021/0087658 A1 Mar. 25, 2021

(30) Foreign Application Priority Data

Sep. 12, 2016 (IN) ..... 201641031017

(51) Int. Cl.
*C22C 33/08* (2006.01)
*B22D 1/00* (2006.01)
(Continued)

(52) U.S. Cl.
CPC ..... *C22C 33/08* (2013.01); *B22D 1/00* (2013.01); *C22C 37/10* (2013.01); *C22C 38/005* (2013.01); *C22C 38/02* (2013.01)

(58) Field of Classification Search
None
See application file for complete search history.

(56) References Cited

U.S. PATENT DOCUMENTS 4,806,157 A * 2/1989 Subramanian ..... C21C 1/10 420/13
2009/0183848 A1* 7/2009 Sillen ..... C22C 37/10 164/57.1
2019/0169705 A1* 6/2019 Knustad ..... C22C 38/005

FOREIGN PATENT DOCUMENTS

CN 102787198 A * 11/2012
WO WO-2006068487 A1 * 6/2006 ..... C21C 1/105

OTHER PUBLICATIONS

English language machine translation of CN-102787198-A. Generated Feb. 6, 2023. (Year: 2023).*

* cited by examiner

*Primary Examiner* — Brian D Walck
(74) *Attorney, Agent, or Firm* — Karthik Murthy; Murthy Patent Law Inc.

(57) ABSTRACT

The present invention pertains to a non-magnesium process to produce Compacted Graphite Iron (CGI) by placing a treatment alloy into a treatment ladle, and then placing an inoculant over the treatment alloy in the treatment ladle and pouring a molten base metal there over. The treatment alloy comprises iron, silicon and lanthanum, wherein lanthanum is 3-30% by weight of the treatment alloy, silicon is 40-50% by weight of the treatment alloy, and the remaining is Iron. Lanthanum in the treatment alloy makes the graphite precipitate as vermiculite (compacted form) instead of flake or
(Continued)

Figure 1:
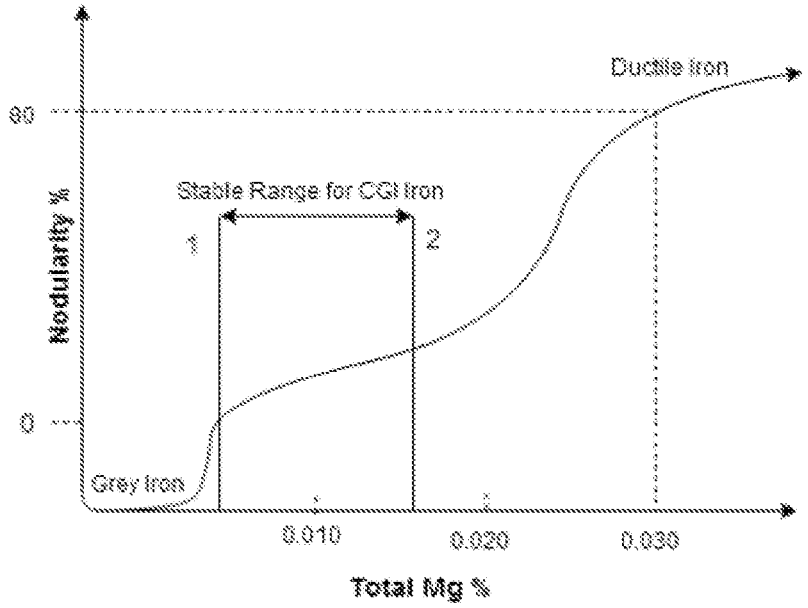

spheroids. With extended process window offered by this new process (0.03-0.1% residual lanthanum in the metal) required to make CGI, this new process removes the stringent process control (0.01-0.02% residual magnesium in the metal) dictated by the magnesium process of making CGI.

15 Claims, 3 Drawing Sheets

(51) Int. Cl.

| | |
|---|---|
| ***C22C 37/10*** | (2006.01) |
| ***C22C 38/00*** | (2006.01) |
| ***C22C 38/02*** | (2006.01) |

(a) Ferritic (b) Pearlitic

NON-MAGNESIUM PROCESS TO PRODUCE COMPACTED GRAPHITE IRON (CGI)

CROSS-REFERENCE TO RELATED APPLICATION

This patent application claims the benefit of and priority to of PCT Patent Application No. PCT/IB2017/055473, filed Sep. 12, 2017, which is incorporated herein by this reference in its entirety.

FIELD OF INVENTION

The present invention relates to a production process of compacted graphite iron (CGI) without the addition of magnesium.

BACKGROUND OF THE INVENTION

Current production of compacted graphite iron (CGI) involves addition of magnesium, a volatile, dangerous and slag generating treatment element. To contain the high reactivity of magnesium and provide ease of handling, normally it is incorporated in ferrosilicon alloy. Thus, ferrosilicon alloys containing various percentage of magnesium are used commonly in the production of ductile iron (DI) and compacted graphite iron (CGI).

Virtually all of the published reports and patents search lists magnesium as the main treatment element for production of CGI. For example few of the them are cited as follows U.S. Pat. No. 4,568,388 a "Magnesium-titanium-ferrosilicon alloys for producing compacted graphite iron in the mold and process using same", U.S. Pat. No. 4,430,123 "Production of vermicular graphite cast iron", U.S. Pat. No. 4,338,129 "Production of vermicular graphite cast iron", U.S. Pat. No. 5,178,826 "Method and apparatus for the production of nodular or compacted graphite iron castings", U.S. Pat. No. 4,501,612 "Compacted graphite cast irons in the iron-carbon-aluminum system", U.S. Pat. No. 4,596,606 "Method of making CG iron", U.S. Pat. No. 5,758,706 "Process control of compacted graphite iron production in pouring furnaces", U.S. Pat. No. 5,639,420 "Method of manufacturing compacted graphite cast iron".

The method of CGI production using magnesium as the main treatment alloy causes fumes, flashes, violence and generates good amount of slag. Also, the process requires a very tight control of residual magnesium in the metal within a very narrow window of 0.008% Mg. CGI formation is stable only a range of 0.008% magnesium only. Below the lower limit, graphite grows as flake and above the upper limit, graphite grows as spheroids. Even small amounts of graphite flakes present in the microstructure reduce the mechanical properties. Presence of excess graphite spheroids in the microstructure reduce the casting and physical properties. Thus a close control of magnesium is a must for successful production of CGI. This control of magnesium within the stable range of 0.008% dictates very strict and tight process control requiring constant monitoring and corrective actions.

Magnesium is being used for the production purpose of the compacted graphite Iron, but it comes with many disadvantages; in the presence of excess magnesium, the graphite nodules are formed as in case of ductile iron instead of graphite in vermicular form or in the presence of less magnesium flake form as in case of grey cast iron. Magnesium is the most commonly used alloy in spite of having limitations like: a) limited solubility in cast iron, it is only 0.04 percent, b) very low boiling point, it is only 1107° C. which makes it very quickly violent, c) requirement of close control over treatment during magnesium treatment as well as during pouring of molds after the magnesium treatment, which also means a constant monitoring of the reaction is mandatory to make sure the reaction does not over react and cause a different variety of cast iron, d) it is a potent carbide stabilizer, e) it is not effective in neutralizing tramp elements coming from steel scrap and other raw materials containing lead, zinc, titanium, arsenic, antimony and bismuth, f) extreme volatility and production of fumes giving rise to detrimental and objectionable atmosphere in foundry.

CGI can also be produced by other methods—again with magnesium as the treatment alloy but with must addition of anti-elements like titanium, aluminum, and zirconium. These methods have their own disadvantages and are not as popular as the controlled magnesium alone process.

An example of such can be found in the patent application U.S. Pat. No. 5,639,420 by Sanders et al, where in the most well-known method, the ladle treatment is used. According to Sanders et al, the treatment of an alloy, consisting of FeSiMgRECa, wherein RE refers to rare earth metal, Si reacts with the iron and the magnesium is added in to the alloy for the reaction purposes. The practice of using rare earth metal along with the alloy is well known, but the selection of amount of such any specific rare earth metal is the key to obtain a substantial quality of the compacted graphite iron. Few example of rare earth used as alloy components to produce compacted graphite iron can be cited by the patent application such as U.S 20090123321 A 1, in which a high-silicon ferritic CGI is being produced using alloy where in the selected rare earth metal is chromium with in a magnesium ferrosilicon alloy. In all the above process, RE refers to rare earth alloy containing cerium, and lanthanum, or cerium, lanthanum, neodymium, praseodymium with trace levels of other lanthanides.

Torbjorn Skaland in the patent application US20040042925 for the purpose of nodularizing treatment of ductile iron used a ladle treatment method for nodularizing of a magnesium ferrosilicon alloy for which he uses lanthanum as the rare earth metal in the range of0.3% to 5% by weight as an inoculant. Dremann and Fugiel in the patent application U.S. Pat. No. 4,568,388 A, for the purpose of producing compacted graphite iron by using magnesium titanium ferrosilicon alloy, for which he uses 0.5% of calcium and 0-2% of aluminum and the rest is balanced iron as an additive to the alloy.

OBJECTIVE OF THE INVENTION

The objective of the present invention is to provide a compacted graphite iron (CGI) production process which is a non-magnesium process.

SUMMARY OF THE INVENTION

The present invention pertains to a non-magnesium process to produce compacted graphite iron by placing a treatment alloy into a treatment ladle, and then placing an inoculant in the treatment ladle and pouring a molten base metal there over. The treatment alloy comprises iron, silicon and lanthanum, wherein lanthanum is 3-30% by weight of the treatment alloy, silicon is 40-50% by weight of the treatment alloy, and the remaining is iron.

According to another embodiment of the invention the non-magnesium process to produce compacted graphite iron involves a treatment alloy containing ferro silicon lanthanum alloy with lanthanum in the range of 3-10% by weight of the treatment alloy.

According to a further embodiment of the non-magnesium process to produce compacted graphite iron, the treatment alloy further comprises at least one of calcium and aluminum or in combination thereof, and calcium and aluminum are in range of 0.5-3% each by weight in the treatment alloy.

According to a preferred embodiment of the non-magnesium process to produce compacted graphite iron, the treatment alloy is 0.4-2% by weight of the base metal, and the inoculant is 0.1-0.5% by weight of the base metal.

According to yet another embodiment of the non-magnesium process to produce compacted graphite iron, the treatment alloy is treated with a base metal which comprises 3-5% carbon by weight, 2-5% silicon by weight and less than 0.016% sulfur by weight of base metal.

According to an alternate embodiment of the non-magnesium process to produce compacted graphite iron, the base metal further comprises at least one or combination of manganese, copper, tin, antimony, molybdenum, vanadium, chromium and other pearlite promoting alloying elements.

As per yet another embodiment of the non-magnesium process to produce compacted graphite iron, at least one of manganese is in range of 0.15-0.8% by weight of the base metal, copper is in range of 0.1-0.8% by weight of the base metal, or tin is in range of 0.01-0.1% by weight of the base metal, or a combination thereof.

According to a preferred embodiment of the non-magnesium process to produce compacted graphite iron the inoculant is a ferrosilicon composition, and the ferrosilicon composition comprises at least calcium, aluminum, barium or lanthanum, or a combination thereof.

According to another embodiment of the non-magnesium process to produce compacted graphite iron, addition of the inoculants is done by placing it on top of the treatment alloy within the treatment ladle, or during transfer from treatment ladle to pouring ladle, or in instream during pouring the casting ladle or as blocks or inserts into the mold during casting the mold, or as blocks or inserts in the sprue during casting into the mold.

According to a further embodiment of the non-magnesium process to produce compacted graphite iron, it is an open pour ladle process wherein the treatment ladle is kept open during the entire treatment process.

According to an alternate embodiment of the non-magnesium process to produce compacted graphite iron wherein producing compacted graphite iron with this treatment process has a wide stable process window with residual lanthanum in the metal in the range of 0.03-0.1%.

According to a preferred embodiment of the non-magnesium process to produce compacted graphite iron, the treatment alloy can be added in the form of lumps, or powder as in cored wires or inserts in in-mold process of producing compacted graphite iron.

BRIEF DESCRIPTION OF THE DIAGRAMS

FIG. 1 Schematically illustrates the process window one has to maintain tightly while using magnesium during manufacturing CGI. Residual magnesium % required to be maintained is 0.01-0.02.

Figure 2:
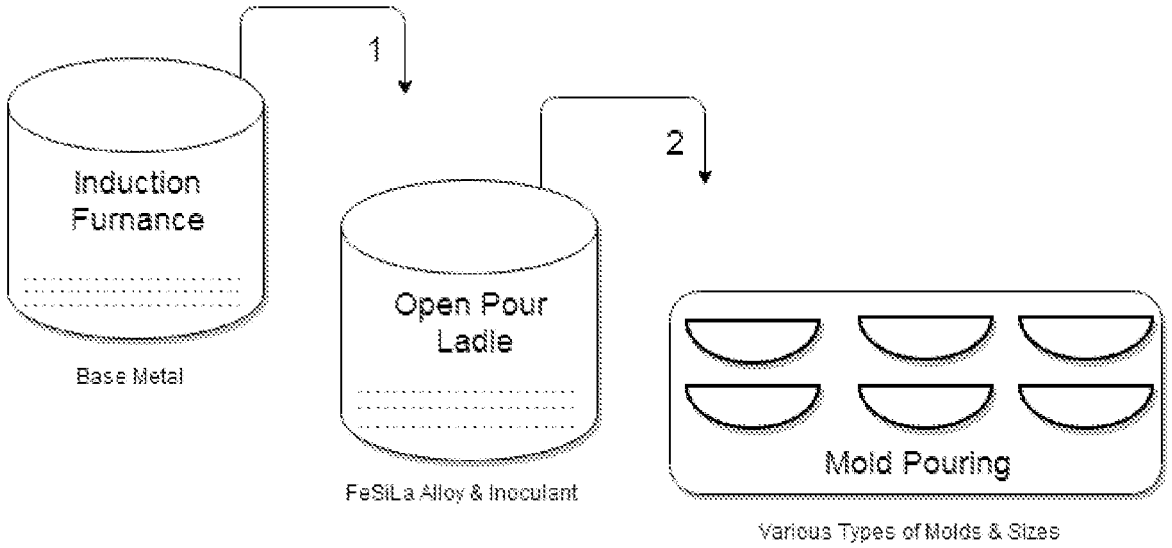
Figure 3:
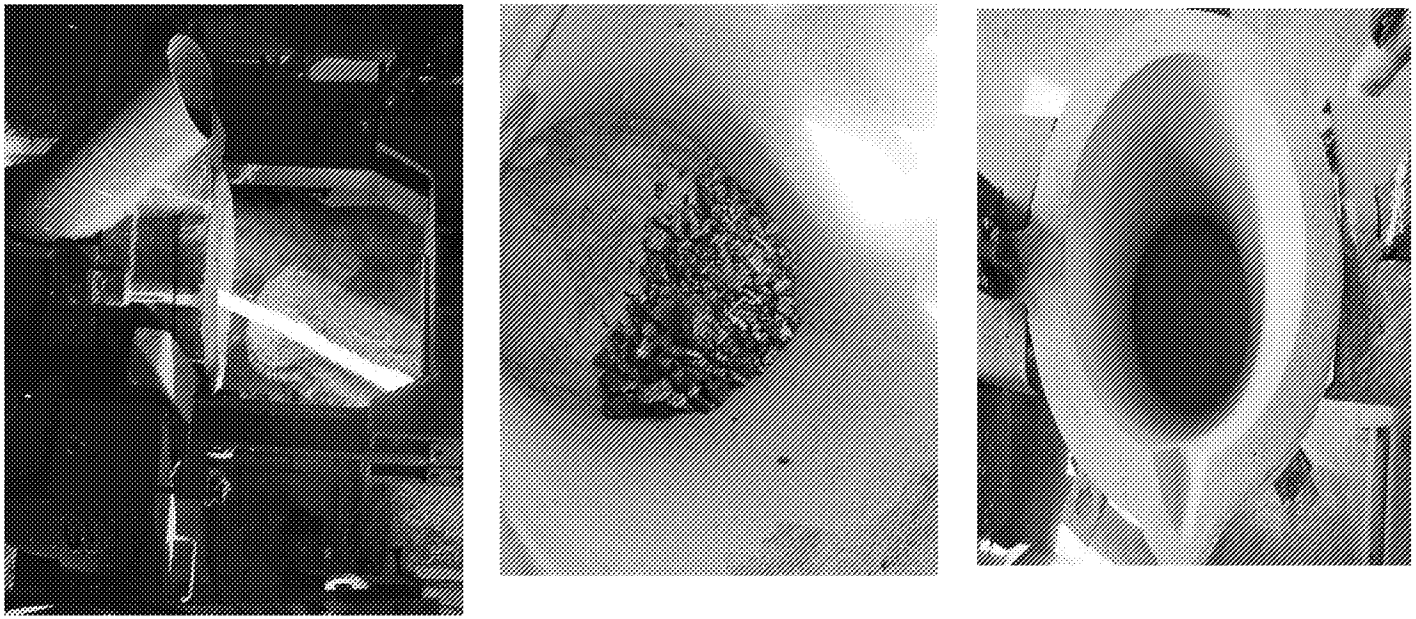
Figure 4:
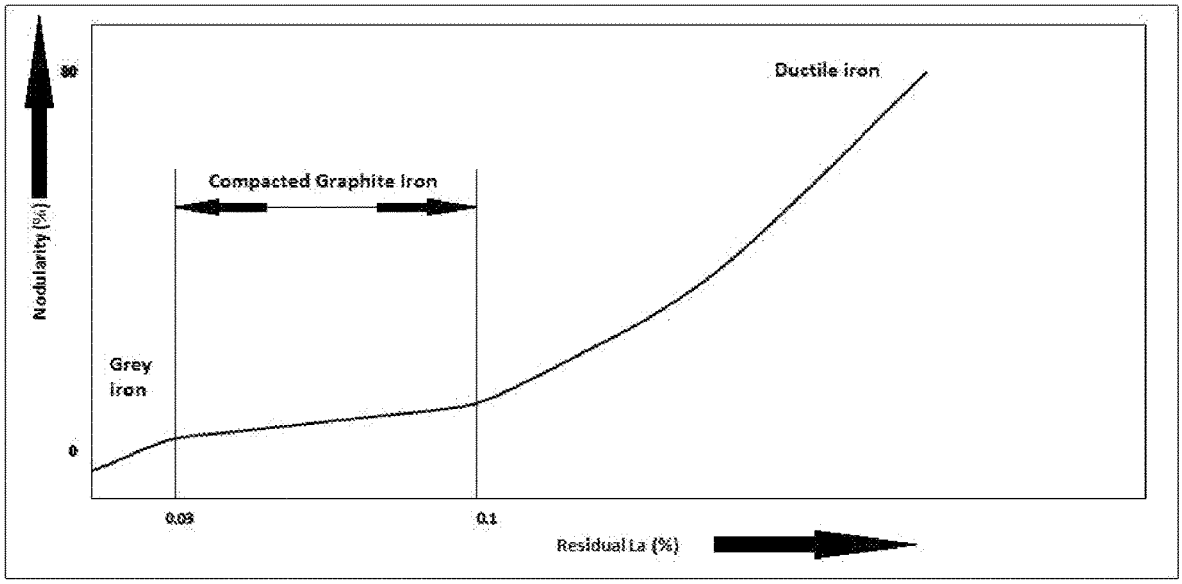

FIG. 2 Illustrates the schematic of this invention process where metal from the furnace is tapped directly into an open treatment ladle containing treatment alloy and inoculant FIG. 3 Illustrates this invention process where metal from the furnace is tapped directly into an open treatment ladle containing treatment alloy and inoculant FIG. 4 Illustrates the wide stable process window range one has to maintain while using this treatment alloy containing lanthanum for the production of CGI. Residual lanthanum % required to be maintained is 0.03-0.1.

Figure 5:
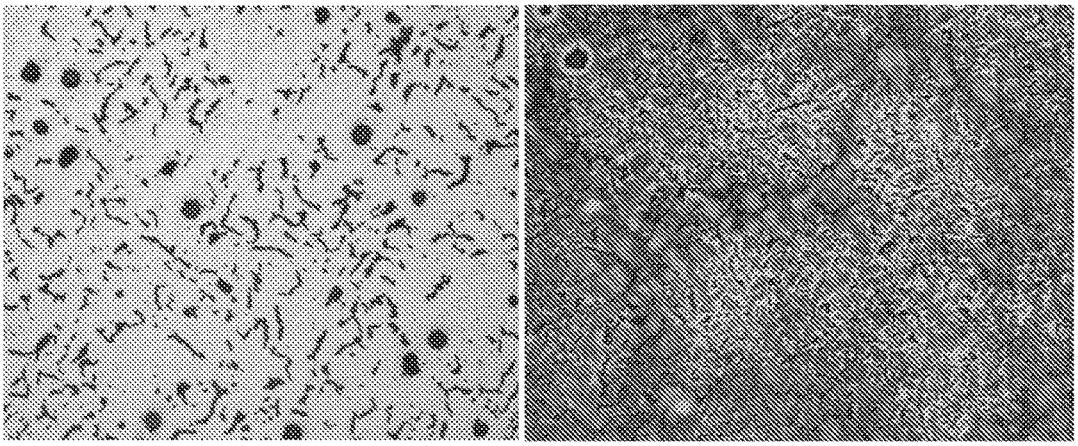

FIG. 5 Illustrates typical microstructure of CGI produced by the lanthanum process (a) ferritic grade (b) pearlitic grade

DETAILED DESCRIPTION

Perhaps, the most stringent concern of using magnesium for the production of CGI is that its use requires close control over magnesium percentage during treating the base metal by magnesium as well as during pouring of molds after the magnesium treatment. In other words, the processing window of the magnesium strictly needs to be monitored and additions of required elements for the process are added at very specific timings, keeping the temperature and the reaction in mind.

FIG. 1 according to Dr Steve Dawson in his paper of process control for production of CGI, 106[m] AFS casting congress, USA, 2002 illustrates a graphical representation of the nodularity percentage in the cast iron versus the magnesium percentage, to determine at what point the transition from flake to CGI and CGI to ductile iron occurs, This 'buffer' is necessary to ensure that flake-type graphite does not form before the end-of-pouring, which may be as long as fifteen minutes after the initial magnesium addition. The total process window is shown between the line 1 and line 2, which points out for a stable formation of compacted graphite iron, further to A which it would solidify as ductile iron. The stable CGI plateau exists over a range of approximately 0.008% magnesium and is separated from grey iron by an abrupt transition.

This invention, as explained further, helps to remove such stringent controlling factor by removing the magnesium completely from the production procedure and permitting or allowing a longer stable processing window for the production of CGI having a longer/wider stable range for the treatment alloy, percentage makes the process more user friendly.

The best and other modes for carrying out the present invention are presented in terms of the embodiments, herein depicted in FIG. 2 The embodiments are described herein for illustrative purposes and are subject to many variations. It is understood that various omissions and substitutions of equivalents are contemplated as circumstances may suggest or render expedient, but are intended to cover the application or implementation without departing from the spirit or scope of the present invention. Further, it is to be understood that the phraseology and terminology employed herein are for the purpose of the description and should not be regarded as limiting. Any heading utilized within this description is for convenience only and has no legal or limiting effect.

The terms "a" and "an" herein do not denote a limitation of quantity, but rather denote the presence of at least one of the referenced item.

FIG. 2 illustrates schematic of process flow of manufacturing compacted graphite iron (CGI). Initially, a treatment alloy is placed into a treatment ladle, which is generally an open pour ladle and then placing an inoculant in the treatment ladle and pouring a molten base metal there over. The treatment alloy comprises of iron, silicon and lanthanum, wherein lanthanum is 3-30% by weight of the treatment alloy, silicon is 40-50% by weight of the treatment alloy, and the remaining is iron, hence forming a treatment alloy to be as FeSiLa or ferro silicon lanthanum alloy. The variations of the treatment alloy could also be such as pure lanthanum metal, iron lanthanum alloy, in-mold alloy with finer sizes of above composition of the treatment alloy. Alternatively, a cored wire with 100% lanthanum powder or FeSiLa powder of varying lanthanum percentage or above two mixed with inoculant powder.

As per the FIG. 2 & FIG. 3, metal is melted in an induction furnace with proper chemistry control and wherein the base metal contains 3 to 5% carbon by weight of the base metal, 1.5 to 5% silicon by weight of the base metal and less than 0.016% sulfur by weight of the base metal. Depending on the grade of CGI, base metal may contain manganese in the range of 0.015 to 0.8% by weight of the base metal, and copper in the range of0.1% to 0.8% by weight of the base metal or tin within the range 0.01% to 0.1% by weight of the base metal which could be also in combination thereof with other elements.

According to a preferred embodiment of the non-magnesium process to produce compacted graphite iron, the treatment alloy is 0.4-2% by weight of the composition of the base metal, and the inoculant is 0.1-0.5% by weight of the composition. Inoculation with ferro silicon inoculants is the final stage in the preparation of graphitic irons and involves the introduction of small quantities of ferro silicon inoculant containing elements such as at least calcium, aluminum, barium or lanthanum, or a combination thereof.

The process according to the FIG. 2 & FIG. 3 involves a treatment alloy consisting of a single rare earth element added as a ferrosilicon alloy. The rare earth metal in the treatment alloy is only lanthanum and could vary from 3 to 30%. The typical composition of the alloy could be silicon (Si) of 40 to 50%, and lanthanum (La) from 3 to 30%, the rest could be iron (Fe) along with few recommended additives like calcium (Ca) and aluminum (Al) of 1% each or more as per the quantity required to produce the CGI. In another embodiment, the treatment alloy may have calcium and aluminum in the rage 0.5% to 3% each by weight of the treatment alloy.

The beneficial effects of lanthanum is in reducing chill and carbide formation in any cast iron indicating that the role of lanthanum in rare earth additions used to produce compacted graphite cast iron (CG cast Iron) is important. Mostly it's been seen that rare earth metals are added into the formation of such alloys but in mixture of two or more rare earth metal but it is the focus of this invention to bring out the advantageous of using only lanthanum as a single rare earth metal.

In another embodiment, the inoculant is added during the transfer of metal from the furnace to treatment ladle, or from the treatment ladle to the pouring ladle or in stream during pouring of the ladle into molds or as blocks or inserts into the mold during pouring into the mold cavity, or as blocks or as inserts in the mold during casting into the mold. The treatment ladle could be kept open the whole time of the process. Once the treatment ladle consisting of the treatment alloy and the inoculant is ready, the base metal form the induction furnace is poured into the treatment ladle directly, which then results in compacted graphite iron.

FIG. 4 is an extension to the FIG. 1 and is enabled to show the best range that one can limit to as the wide stable process one has to maintain while using this treatment alloy containing lanthanum for the production of CGI. FIG. 5 is an exemplary image of the results occurred by using this process of using only lanthanum. The images in FIG. 5 are typical microstructure of CGI produced in two grades (a) ferritic grade and (b) pearlitic grade.

Once the treatment process is finished, the metal is then poured into a variations of holdings that could be just another ladle for the convenience or pouring directly into casting molds.

The above-mentioned descriptions represent merely the exemplary embodiment of the present disclosure, without any intention to limit the scope of the present disclosure thereto. Various equivalent changes, alterations or modifications based on the claims of present disclosure are all consequently viewed as being embraced by the scope of the present disclosure.

We claim:

1. A non-magnesium process to produce compacted graphite iron comprising by placing a treatment alloy into a treatment ladle, placing an inoculant there over in the treatment ladle and pouring a molten base metal there over, wherein said treatment alloy comprises iron, silicon and lanthanum, wherein the lanthanum is 3-30% by weight of the treatment alloy, and silicon is 40-50% by weight of the treatment alloy, wherein the treatment alloy optionally comprises at least one of calcium and aluminum in a range of 0.5-3% each by weight of the treatment alloy, and the rest of the treatment alloy is iron, and required additional percentage of said treatment alloy is 0.4-2% by weight of composition of said base metal, and said inoculant is 0.1-0.5% by weight of the composition, wherein the inoculant optionally is a ferrosilicon composition comprising at least one of calcium, aluminum, barium or lanthanum, or combination thereof.

2. The non-magnesium process to produce compacted graphite iron according to claim 1, wherein said lanthanum is in a range of 3-10% by weight of the treatment alloy.

3. The non-magnesium process to produce compacted graphite iron according to claim 1, wherein the treatment alloy comprises at least one of calcium and aluminum or a combination thereof, wherein calcium and aluminum are in a range of 0.5-3% each by weight of the treatment alloy.

4. The non-magnesium process to produce compacted graphite iron according to claim 2, wherein the treatment alloy comprises at least one of calcium and aluminum or a combination thereof, wherein calcium and aluminum are in a range of 0.5-3% each by weight of the treatment alloy.

5. The non-magnesium process to produce compacted graphite iron according to claim 1, wherein said treatment alloy is treated with a base metal which comprises 3-5% carbon by weight of the base metal, 1.5-5% Silicon by weight of the base metal, and less than 0.016% sulphur by weight of base metal.

6. The non-magnesium process to produce compacted graphite iron according to the claim 5, wherein the base metal comprises at least one of manganese, copper, tin, antimony, molybdenum, vanadium or pearlite promoting alloying elements to increase the strength of the metal.

7. The non-magnesium process to produce compacted graphite iron according to claim 6, wherein at least said manganese is in a range of 0.15-0.8% by weight of the base metal, copper is in a range of 0.1-0.8% by weight of the base metal, or tin is in a range of 0.01-0.1% by weight of the base metal, or combination thereof.

8. The non-magnesium process to produce compacted graphite iron according to claim 1, wherein said inoculant is a ferrosilicon composition, the ferrosilicon composition comprising at least one of calcium, aluminum, barium or lanthanum, or combination thereof.

9. The non-magnesium process to produce compacted graphite iron according to claim 2, wherein said inoculant is a ferrosilicon composition, the ferrosilicon composition comprising at least one of calcium, aluminum, barium or lanthanum, or combination thereof.

10. The non-magnesium process to produce compacted graphite iron according to claim 1, wherein adding inoculant is done:

by placing on top of the treatment alloy with in the treatment ladle, or during transfer from treatment ladle to pouring ladle, or in instream during pouring into the casting mold, or as blocks or inserts in the mold during casting into the mold.

11. The non-magnesium process to produce compacted graphite iron according to claim 2, wherein adding inoculant is done:

by placing on top of the treatment alloy with in the treatment ladle, or during transfer from treatment ladle to pouring ladle, or in instream during pouring into the casting mold, or as blocks or inserts in the mold during casting into the mold.

12. The non-magnesium process to produce compacted graphite iron according to claim 1 is an open pour ladle process wherein the treatment ladle is kept open during the treatment process.

13. The non-magnesium process to produce compacted graphite iron according to claim 2 is an open pour ladle process wherein the treatment ladle is kept open during the treatment process.

14. The non-magnesium process to produce compacted graphite iron according to claim 1, wherein the treatment alloy can be added in the form of lumps, or powder as in cored wires or inserts in in-mold process of producing compacted graphite iron.

15. A non-magnesium process to produce compacted graphite iron comprising by placing a treatment alloy into a treatment ladle, placing an inoculant there over in the treatment ladle and pouring a molten base metal there over, wherein said treatment alloy comprises iron, silicon and lanthanum, wherein the lanthanum is 3-10% by weight of the treatment alloy, and silicon is 40-50% by weight of the treatment alloy, wherein the treatment alloy comprises at least one of calcium and aluminum in a range of 0.5-3% each by weight of the treatment alloy, and the rest of the treatment alloy is Iron, and required additional percentage of said treatment alloy is 0.4-2% by weight of composition of said base metal, and said inoculant is 0.1-0.5% by weight of the composition, wherein the inoculant optionally is a ferrosilicon composition comprising at least one of calcium, aluminum, barium or lanthanum, or combination thereof.

* * * * *